United States Patent [19]

Johnson

[11] 4,162,708

[45] Jul. 31, 1979

[54] TOOL CARRYING VEHICLE WITH LASER CONTROL APPARATUS

[75] Inventor: Phillip R. Johnson, Mandan, N. Dak.

[73] Assignee: Dakota Electron, Inc., Mandan, N. Dak.

[21] Appl. No.: 546,544

[22] Filed: Feb. 3, 1975

[51] Int. Cl.[2] ..... E02F 3/76; E02F 3/85

[52] U.S. Cl. ..... 172/4.5; 33/185 V; 37/DIG. 20

[58] Field of Search ..... 172/2, 4, 4.5; 33/185 V, 286, 287; 74/25, 424.88; 37/DIG. 20; 250/203 R, 236, 239; 235/92 MP; 318/9, 10, 14, 15; 340/347 AD; 356/4, 152, 172, 248, DIG. 1; 404/84

[56] References Cited

U.S. PATENT DOCUMENTS

| | | | |
|---|---|---|---|
| 2,796,685 | 6/1957 | Bensinger | 172/4.5 X |
| 3,141,418 | 7/1964 | Clayborne et al. | 356/172 X |
| 3,462,845 | 8/1969 | Mathews | 33/286 X |
| 3,469,919 | 9/1969 | Zellner | 356/4 |
| 3,494,426 | 2/1970 | Studebaker | 172/4.5 |
| 3,588,255 | 6/1971 | Alexander | 356/172X |
| 3,620,626 | 11/1971 | Daly et al. | 356/4 |
| 3,742,488 | 6/1973 | Von Voros | 340/347 AD |
| 3,811,648 | 5/1974 | Ream, Jr. et al. | 250/203 R X |
| 3,844,177 | 10/1974 | Bourassa | 74/424.8 B X |
| 3,887,012 | 6/1975 | Scholl et al. | 172/4.5 |

OTHER PUBLICATIONS

"On-Site Equipment Goes Automatic, Too," Engineering News-Record, Dec. 9, 1965, p. 40.

*Primary Examiner*—Richard T. Stouffer

*Attorney, Agent, or Firm*—Williamson, Bains, Moore & Hansen

[57] ABSTRACT

A tool-carrying vehicle, such as a road grader, is provided with an apparatus for maintaining a predetermined distance between its blade or other tool and a laser reference plane generated by a rotating laser beam. The apparatus includes a detector housing supported on a mounting extending upwardly from the blade, a detector support frame on the housing, a laser reference plane detector on the support frame, and electrical control circuitry. The mounting is movable to permit moving the detector housing relative to the vehicle in response to tool movement.

The laser reference plane detector has first and second spaced apart laser beam detecting arrays. The detector may be provided with upper and lower movable carriages with one of the arrays positioned on each carriage, permitting the carriages to converge and diverge to vary the distance separating the detecting arrays and thereby control the degree of accuracy required of the tool. In addition, the detector housing may be rotated about is axis to scan an arc for the laser beam.

The elevation and slope of the blade or tool may be automatically controlled as a function of position or time by a computer carried by the vehicle and operating under a predetermined computer program to thereby accurately grade a given area.

8 Claims, 9 Drawing Figures

CONTROL CIRCUITRY
DISPLAY
BCD COUNTER

TOOL CARRYING VEHICLE WITH LASER CONTROL APPARATUS

BACKGROUND OF THE INVENTION

The invention relates to the field of construction vehicles and to detection of a laser reference plane in order to permit accurate and controlled positioning of a tool carried by a construction vehicle, the tool being carried at a predetermined distance from the laser reference plane as the vehicle moves along a land surface.

In many fields of construction, such as earth grading, road construction, ditch digging, curb laying and the like, it has been recognized that a reference line or plane is needed to accurately lay out the route or elevation of the road, curb or ditch. In recent years the desirability of using a laser reference plane positioned above the working vechicle has been appreciated, and apparatuses have been evolved to utilize such a plane in the guidance of a tool carrying vehicle.

One of the principal uses for such a laser reference plane is for land grading where a road grader or the like must level substantial areas of land for roads, new construction, parking lots, air fields or the like. It is known to equip an earth grader with a laser beam detector and to have the detector automatically follow a laser reference plane. It is also known to raise and lower the grader blade as the detector follows the laser plane in order to keep the blade a predetermined distance from the detector. Using these techniques, prior art devices have endeavored to keep the grader blade at approximately the predetermined distance below the laser reference plane and to thereby closely control the elevation of the land being worked.

The known detector apparatuses for following the laser reference plane utilize a pair of vertically positioned photocells with upper and lower cells spaced apart to receive and keep the laser plane therebetween. The photocells have been mounted on a planar surface and face in the same single direction. For best reception of the laser beam, the detector must be oriented with the plane of the detector roughly perpendicular to the source of laser light so the photocells confront the laser beam source. While it is possible to receive the laser beam with the photocells even when the photocells do not directly confront the laser beam, in practice the arc through which the photocell may successfully receive and detect a laser beam is approximately 100°. Accordingly, if the laser beam source is outside this arc, the detector will not respond to or detect the laser reference plane. Accordingly, the known detectors must be kept in fairly directly confronting relationship with the laser source and continually manipulated to face the laser source each time the vehicle turns. It can be readily appreciated that a construction vehicle moving over an irregular land surface is frequently turning and accordingly it is difficult and inconvenient to keep the known detectors in continuous confronting relationship with the laser source. It would be desirable to provide a laser beam detector which is responsive over a substantially larger arc and preferably through 360° to thereby eliminate the risk of losing contact between the laser beam source and the detector due to the detector facing in the wrong direction.

The available detectors have the upper and lower photosensitive cells closely spaced at a fixed, unvarying distance apart, and the object is to keep the laser reference plane positioned between these upper and lower photocells. This object can be a very difficult one during relatively coarse grading when the road grader moves over uneven ground with attendant bouncing and pitching movement. Under such conditions the detector can suddenly shift above or below the laser reference plane and easily lose the laser plane. When such loss occurs, the detector must be moved upwardly or downwardly to pursue and search for the laser reference plane. When the vehicle is frequently bouncing and pitching, the searching action of the detector can be substantial, and considerable inaccuracy in the grade level can result when the detector is out of contact with the laser plane.

Because the width of laser beams increases linearly with distance from the laser source, the beam width and accordingly the laser reference plane thickness increase with distance from the laser source. As a result, it is desirable to have the upper and lower photocells positioned at a greater distance apart when grading is done a substantial distance from the laser source and to have the cells more closely spaced for projects near the laser source. The existing detectors are less effective when used at substantial distances from the laser source because the laser plane thickness is greater and the known detectors cannot vary the distance separating the photocells. At greater distances the laser plane can be thick enough to continually impinge on both upper and lower photocells of known detectors, and such impingement provides the known detectors with contradictory and unusable information because the detector would erroneously be led to move both upwardly and downwardly to follow the laser plane.

It is desirable to provide a detection apparatus which can be used at all working distances from the laser source and be equally adaptable for both fine and coarse grading, with minimal problems of following the laser reference plane under likely-to-be encountered land surface conditions. The present invention meets these needs and provides a greatly improved apparatus by which tool position can be carefully controlled relative to the laser reference plane.

SUMMARY OF THE INVENTION

The invention comprises an apparatus for maintaining a predetermined distance between a laser reference plane and a grading blade or other tool carried by a tool carrying vehicle. The invention utilizes a substantially improved detector unit which has a detector housing supported by a mounting which is movable relative to the vehicle, the housing carrying a detector support frame provided with an outer periphery facing outwardly from the housing in a plurality of directions. First and second laser beam detecting arrays, each of which includes a plurality of light-sensitive devices, are attached to the outer periphery of the support frame and face outwardly from the outer periphery in a plurality of directions, permitting the laser beam to be detected through a substantially greater arc than possible with prior art planar type detectors. The light-sensitive devices of each array are centered on a common plane, the common planes of the first and second arrays being generally parallel to and spaced from one another to define a zone between them which is positioned the predetermined distance from the tool. The first and second detector arrays produce first and second control signals, respectively, in response to detecting the laser reference plane.

A mounting supports the detector housing for movement of the housing relative to the vehicle and moves in response to movement of the blade or other tool of the vehicle. Movement of the tool toward or away from the laser plane causes the mounting to move the detector housing to keep the laser plane between the detecting arrays.

The first and second detecting arrays are electrically connected to electrical control circuitry to deliver the first and second control signals to the control circuitry. The control circuitry is responsive to the control signals to actuate a power device to raise or lower the tool, resulting in the detector housing being moved by the mounting, causing the detector to closely follow the laser reference plane to retain the reference plane between the detecting arrays, thus keeping the tool at the predetermined distance from the laser reference plane.

The outer periphery of the detector support frame may have any of a variety of shapes, but it is preferred that it be cylindrical or have a polygonal cross section. Light-sensitive devices are positioned on the outer periphery of and face outwardly in a plurality of directions to receive a laser beam through a wide arc that may be as large as 360°, depending on the positioning of the devices. If the light-sensitive devices substantially encompass the outer periphery, the detector can be responsive to a laser beam throughout a 360° arc centered on the detector housing, and accordingly such a detector need not be rotated about an axis to follow the laser beam source as the vehicle changes its direction of travel. In the event the light-sensitive devices are positioned to cover an arc of less than 360° and centered on the detector housing, the detector housing or support frame may be rotated about an axis substantially perpendicular to the laser plane and thereby remain in contact with the laser reference plane, the rate of rotation preferably being at least twice the angular velocity of the rotating laser source.

The support frame includes first and second carriages which are mounted for movement toward and away from one another to thereby vary the distance of separation between the detecting arrays, the first detecting array being on the first carriage and the second array on the second carriage. Because the distance of separation between the upper and lower detecting arrays can be continuously varied between defined limits, the operator may vary the distance of separation to adapt the detector to coarse or fine grading. When fine grading is to be done and the grader will be moving upwardly and downwardly relative to the laser plane only slightly in following the terrain, the distance of separation between the detecting arrays can be small. However, when coarse grading is done and the vehicle is substantially rising and falling relative to the laser plane, it is advisable that the detecting arrays be positioned farther apart so that the laser plane is more easily contained in the zone between the detecting arrays. During coarse grading the increased distance of separation between the detecting arrays greatly diminishes the amount of servo oscillation which can otherwise occur as a detector endeavors to follow a laser plane and permits the establishment of a zone whose width defines the acceptable tolerance of the tool. This error tolerance is readily adjustable by moving the carriages toward or away from one another.

The movably mounted carriages are also used to define a wider zone when the vehicle is operating at substantial distances from the laser source where the laser beam divergence results in a beam of greater thickness. If the zone width were constant and closely spaced, such increased thickness of the laser beam could cause the beam to actuate both upper and lower detecting arrays. Accordingly, the movable carriages make the detector effective at both short and long distances from the source of laser light.

The invention may be provided with measuring means in the form of an incremental encoder coupled between the detector housing and the tool to permit the immediate determination of distance between the tool and the detector. An output signal from the measuring means is electrically conducted to a digital display unit positioned in the cab of the vehicle so that a visible, digital display of the distance of separation between tool and detector is provided to the operator. This permits the operator to know at all times the distance from the laser plane at which the blade or tool is operating.

The vehicle may also be provided with a computer programmed to define a series of tool operations in a given geographic area, the program establishing the elevation of the tool as a function of the vehicle position. A position indicating means is provided on the vehicle to generate electrical position signals which are delivered to the computer to provide information of the instantaneous position of the vehicle in the geographic area. A steering sensor positioned on the vehicle generates an electrical signal indicating the position of the steering device by which the vehicle is steered and delivers the signal to the computer. A steering control apparatus is mechanically connected to the steering device to move the steering apparatus in accord with command signals from the computer. Accordingly, the computer can compare the desired tool elevation contained in the computer program with the actual tool elevation indicated by the measuring means and actuate the power device to set the tool at the desired elevation. Simultaneously, the computer can use the electrical position signal to determine the position of the vehicle in the geographic area and determine the instantaneous setting of the steering device from the steering sensor; after comparing the instantaneous position and the desired position as determined by the computer program, the computer actuates the steering control apparatus to direct the vehicle along a predetermined path defined by the program.

These and other advantages of the present invention will be apparent from the following description and the appended drawings.

DESCRIPTION OF THE PREFERRED EMBODIMENTS

Figure 1:
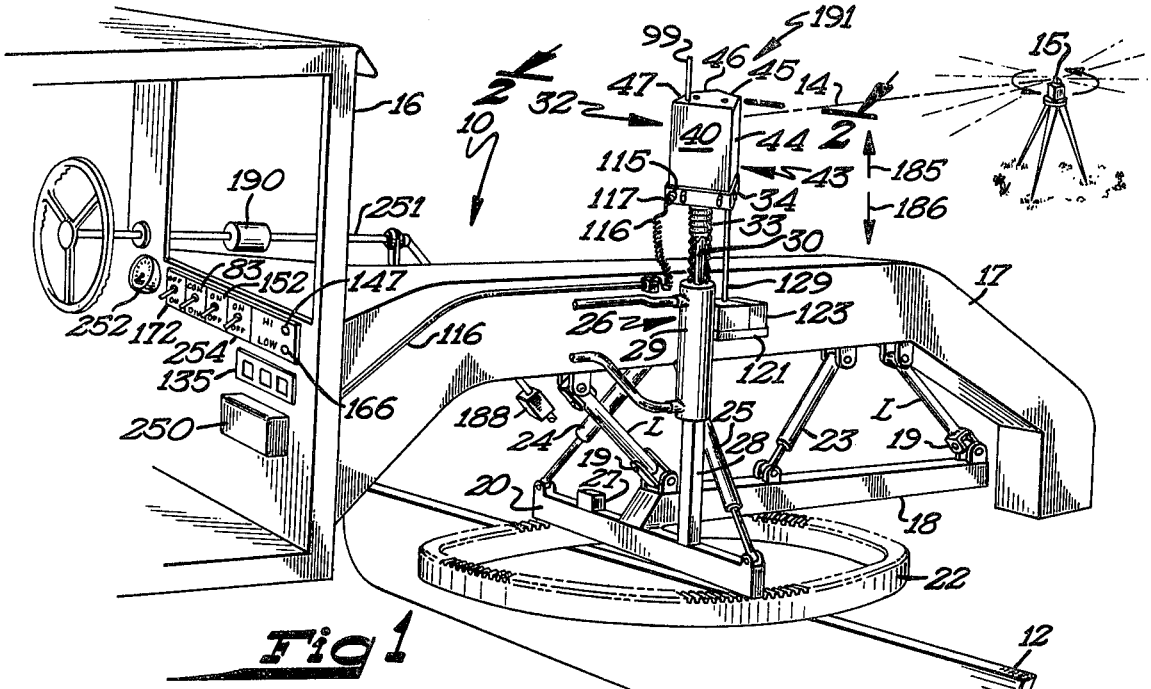
FIG. 1 is a perspective view of a road grader utilizing the invention.

Referring now to FIG. 1, a road grader 10 or other tool carrying vehicle is provided with a movably mounted blade 12 and carries apparatus for maintaining a predetermined distance between the blade 12 and a laser reference plane 14 generated by a laser beam source 15 which rotates about a generally upright axis to generate the horizontal plane 14 or a plane inclined to the horizontal at some predetermined angle.

The grader 10 has a cab 16 and a forwardly extending frame member 17 which supports the blade 12 and associated hardware for setting and operating the blade. A drawbar 18 is attached to the frame member 17 through a pivotally mounted parallelogram linkage having parallel links L pivotally mounted to the frame member 17 and also pivotally mounted to drawbar 18 through the universal joints 19. The linkages L permit the drawbar 18 to be raised and lowered by cylinder 23 while keeping the longitudinal axis of the drawbar substantially parallel to the earth at all times. The universal mountings 19 permit rotation of the drawbar 18 about its longitudinal axis to alter the slope of the blade 12 relative to a horizontal axis. The drawbar 18 is rigidly fixed to crossbar 20 which carries worm wheel 22, the wheel 22 being rotatable relative to crossbar 20 to change the angle of the blade 12 as is well known in the grading art.

A remotely actuated hydraulic cylinder 23 is pivotally mounted between the frame member 17 and drawbar 18 and comprises a power device for raising and lowering the blade 12 to move it toward and away from the laser reference plane 14.

Hydraulic slope cylinders 24 and 25 are interconnected between the frame of the grader 10 and the crossbar 20 to move the blade 12 to alter the slope of the blade. An electrical slope sensing device 27 may be mounted on the crossbar 20 and produces an electrical slope signal indicating the angle of the blade 12 relative to a horizontal axis, the slope signal being used for a purpose to be described hereafter.

While not expressly shown in FIG. 1, the vehicle 10 is provided with a power supply to energize the vehicle and to operate all of the electrical and hydraulic equipment associated with the grader 12. The term "power supply" as used herein is intended to include sources of electrical energy, rotational energy and an operational hydraulic or pneumatic system for actuating the hydraulic or pneumatic cylinders used with the grader.

While a particular grader structure has been described and is particularly well suited for use with the invention, it should be understood that the shown grader structure is provided only by way of illustration and that the invention may be used with substantial benefit on any grader structure.

An upright post 28 is fixed to the crossbar 20 and supports a hydraulic cylinder 29 having an uprightly extending piston 30 on which a detector unit 191 is carried, as will be described further hereafter. The hydraulic cylinder 29 with its movable piston 30 defines a generally upright mast and is part of a mounting carried by the vehicle and movable relative to the vehicle to move the detector unit 191 and its detector housing 32 in response to movement of the blade 12 or other tool. If desired, the piston 30 may be housed within and protected by an expandable rubber sleeve 33.

Figures 2, 8:
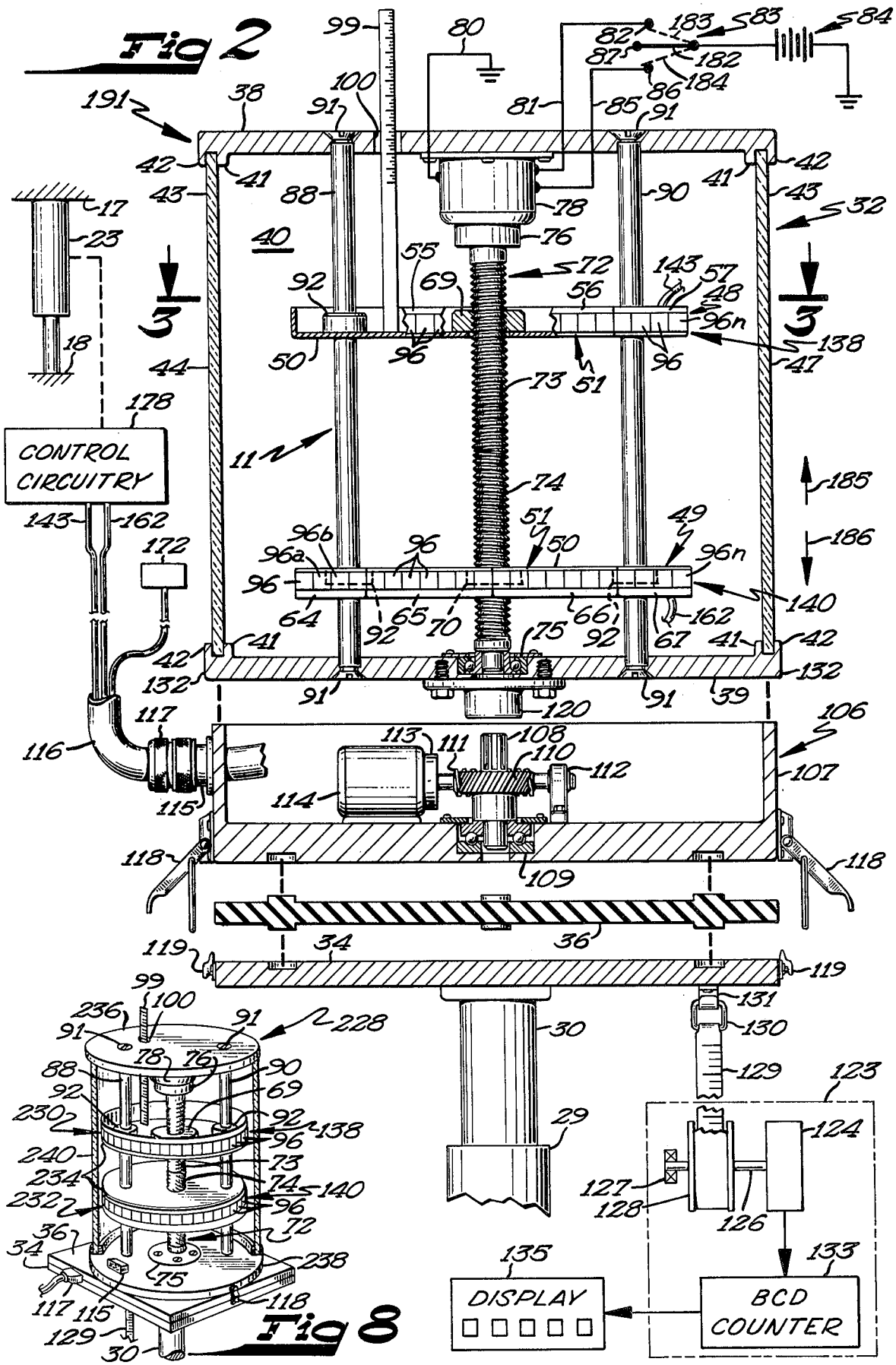
FIG. 2 is a partially cut away front elevation view of the laser beam detector unit used with the road grader vehicle of FIG. 1, taken along cutting plane 2—2 of FIG. 1.
FIG. 8 is a perspective drawing of a third embodiment of a detector unit usable with a tool carrying vehicle.

Referring now to FIGS. 1 and 2, the upper end of the piston 30 has a platform 34 rigidly fixed thereto to move upwardly and downwardly with the piston 30. The platform 34 includes a shock mounting 36 which may be of any type known to the art and serves to cushion the detector unit 191 from otherwise present jolting and bumping of the blade 12 and to thereby provide isolation to the detector unit 191.

The detector housing 32 has upper and lower rigid, flat, generally parallel plates 38 and 39, respectively, interconnected by a rigid back plate 40. The upper and lower plates 38 and 39, respectively, are each provided with inner lips 41 and outer lips 42 extending about their edges and terminating at the back plate 40, the inner and outer lips being used to retain an optical filter 43 therebetween. The optical filter 43 has a series of adjoining faces 44, 45, 46 and 47 angled relative to one another and having optical properties such that light frequencies generated by the laser source 15 are passed through the filter with minimal attenuation while light frequencies associated with ambient light are substantially attenuated. The upper and lower plates 38 and 39, respectively, the back plate 40, and the filter 43, interconnected in any known manner, collectively comprise a detector housing 32.

Positioned within the detector housing 32 are first and second movably mounted carriages 48 and 49, respectively, which are substantially identical to one another, and accordingly only one of which will be described in detail.

The upper carriage 48 has a rigid base plate 50 and an outer periphery 51 having four adjoining faces 54, 55, 56 and 57 facing outwardly in a plurality of directions and respectively paralleling and confronting filter faces 44, 45, 46 and 47. It is desirable that the faces of the outer periphery 51 of each carriage and the confronting filter face of the filter 43 be parallel so that minimal laser light loss occurs. Although the spacing between the outer periphery 51 of the carriage and the filter faces is not critical, a distance of 6 to 9 inches of separation is preferred.

The lower carriage 49 is provided with an identical base plate 50 and outer periphery 51, the base plates 50 of the upper and lower carriages being substantially parallel and confronting one another. The faces 54, 55, 56 and 57 of upper carriage 48 extend sharply upwardly from the plate 50 at a substantially right angle to the plate 50 and are respectively parallel to faces 64, 65, 66 and 67 of the lower carriage 49, faces 64–67 comprising the outer periphery 51 of carriage 49.

The carriages 48 and 49 have vertically and coaxially aligned, threaded sleeves 69 and 70, respectively, each sleeve being rigidly fixed to the base plate 50 of a carriage and having its threaded aperture on and engaging the threads of upright shaft 72.

The elongated threaded shaft 72 has left- and right-hand threads 73 and 74, respectively, adjacent opposed ends thereof, and threaded sleeves 69 and 70 threadably engage the threads 73 and 74, respectively, such that forward and reverse rotation of the shaft 72 causes converging and diverging movement, respectively, of the carriages 48 and 49. The lower end of the threaded shaft 72 is rotatably journaled in bearing 75, which is fixed to the lower plate 39 in any known manner. The upper end of the shaft 72 is coupled through a clutch 76 to a reversible electric motor 78 which is rigidly fixed to the upper plate 38. The clutch 76 is a slip clutch to prevent burnout of the motor 78 in the event the upper and lower carriages are for any reason prevented from moving.

The motor 78 has a wire 80 extending therefrom to ground. A conductor 81 extends from the motor to terminal 82 of switch 83. The switch 83 is connected to battery 84 of the vehicle power source, one side of which is grounded. A conductor 85 extends from the motor 78 to terminal 86 of the switch 83. Accordingly, when switch 83 contacts terminal 82, the motor is driven in a forward direction, and when the switch 83 contacts terminal 86, the motor 78 is driven in a reverse direction. The switch 83 is also provided with an intermediate off position in the form of terminal 87. The switch 83 is positioned in the cab 16 of the vehicle 10 where it may be easily actuated by the operator to converge or diverge the carriages 48 and 49.

If desired, automatic cutoff switches or microswitches may be positioned adjacent the upper and lower plates 38 and 39 of the housing 32 and connected in series with the conductors 81 and 85 to turn off the motor 78 when the carriages have reached their extreme points of convergence and divergence, identified hereafter.

Referring again to FIG. 2, parallel, rigid, elongated rods 88 and 90 extend between upper and lower plates 38 and 39 and are retained rigidly therebetween by machine screws 91 which pass through apertures in the plates 38 and 39 and threadably engage the ends of the rods 88 and 90. Each of the carriages 48 and 49 is provided with a pair of collars 92 rigidly fixed to the floor plate 50 and which closely, slidably engage the rods 88 and 90. Accordingly the rods 88 and 90 along with the sliding collars 92 constitute one form of guide means usable with the detector unit for directing the converging and diverging movement of the carriages along a path between the upper and lower plates 38 and 39. The upper and lower carriages 48 and 49, rods 88 and 90 and collars 92 collectively comprise one type of detector support frame 11 usable with the invention.

Figure 4:
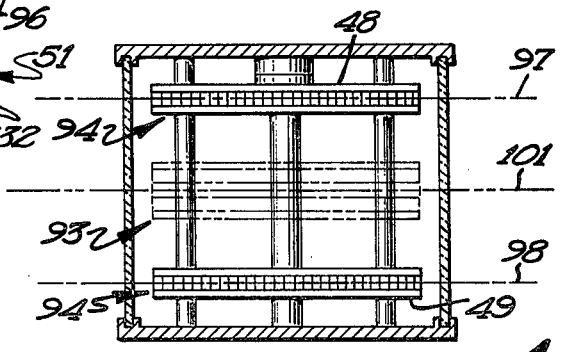
FIG. 4 is a front elevation view of a detector unit like that shown in FIGS. 2, 6 and 8 and illustrates alternative positions of the movable carriages of those detector units.

The motor 78, clutch 76, bearing 75, shaft 72 and sleeves 69 and 70 collectively constitute one form of carriage drive means usable with the invention for moving the carriages 48 and 49 between a fully converged position 93 and a fully diverged position 94, as best shown in FIG. 4. Naturally, the upper and lower carriages may be positioned in numerous intermediate positions between fully converged and diverged positions.

Figure 3:
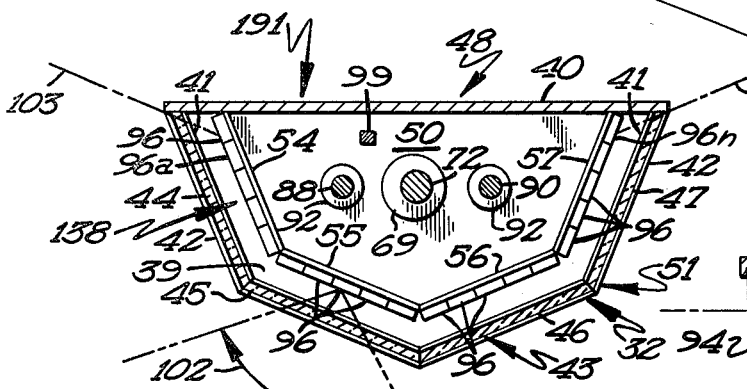
FIG. 3 is a cross-sectional top elevation view of a portion of the detector unit of FIG. 2 taken along cutting plane 3—3 of FIG. 2.

Both upper and lower carriages 48 and 49 carry a plurality of photosensitive devices 96 positioned about the outer periphery 51 of the carriages. In the embodiment of FIGS. 2–4, each of the faces 54, 55, 56 and 57, along with faces 64, 65, 66 and 67, has five photosensitive devices thereon, although it should be understood that a greater or lesser number may be used if desired. Each of the devices 96 is a phototransistor chosen to be responsive to the light frequency of the laser beam but to be relatively unresponsive to light frequencies found in ambient light, as was the case for the optical filter 43.

All of the phototransistors 96 which are positioned on the carriage 48 are centered on a common plane 97, and the five phototransistors on faces 54 and 64 face outwardly from the faces in a single direction perpendicular to faces 54 and 64. The phototransistors on the faces 55 and 65 face outwardly in a second direction generally perpendicular to the faces 55 and 65. Correspondingly those on faces 56 and 66 face outwardly in a third direction and those on 57 and 68 in a fourth direction. Accordingly, the phototransistors positioned on the faces 54, 55, 56, 57, 64, 65, 66 and 67 face outwardly from the detector housing in a plurality of distinct directions so as to be responsive to laser light from a plurality of directions. Correspondingly, the light-sensitive phototransistors positioned on the lower carriage 49 are also centered on a common plane 98, plane 98 being substantially parallel to and spaced from the plane 97 and remaining so during converging and diverging movement of the carriages. As will be described hereafter, all phototransistors of each carriage are connected in parallel with one another, and each phototransistor becomes conducting when struck by an incident laser beam and passes current therethrough.

A calibrated post 99 may be fixed to the base plate of the upper carriage 48 to extend upwardly therefrom, the post passing through an aperture 100 in the upper plate 38. The carriages 48 and 49 are positioned on the threaded shaft 72 such that they converge and diverge in equal increments relative to a common center plane 101, the carriages being equally spaced from the center plane 101 at all times (FIG. 4). Because the distance from the common plane 97 to the center plane 101 is exactly half the distance of separation between the common planes 97 and 98 it is possible to calibrate the post 99 such that an operator can by visual inspection of post 99 determine the distance of separation between planes 97 and 98. The post 99 is so calibrated and provides a visual guide to permit the operator to know at all times the distance separating planes 97 and 98 and accordingly the distance separating the line of centers of the phototransistors on carriages 48 and 49.

The plurality of phototransistors centered on the common plane 97 of upper carriage 48 collectively comprise a first laser beam detecting array 138. The plurality of transistors positioned along the common plane 98 of carriage 49 collectively comprise a second laser beam detecting array 140. Between the first and second detecting arrays is a zone containing no phototransistors, and any laser beams incident in that zone are not sensed or detected by either array. While the first and second arrays need not be movable relative to one another to function as a detector, it is helpful if they are movable and it is preferred that they be mounted on separate carriages for converging and diverging movement.

Referring now to FIG. 3, most phototransistors 96 are responsive to light incident on the detector through an arc 102 of approximately 100°. While phototransistors of various manufacturers may have sensitivity arcs 102 somewhat larger or smaller than 100°, it should be recognized that the phototransistors are capable of receiving laser light within some maximum sensitivity arc because of the geometrical configuration of the phototransistor. By utilizing a detector facing outwardly in a plurality of directions, it is possible to substantially increase the arc through which the detector as a whole is responsive. The shown detector of FIG. 3 is capable of receiving and detecting laser beams through an arc substantially greater than 180° when the detector faces are formed in the geometrical configuration of a half-section of a regular octagon. The lines 103 and 104 indicate the aproximate extremes through which the detector 191 of FIG. 3 is responsive to laser beams using commercially available phototransistors.

To further increase the effective arc through which the detector unit 191 is responsive, the detector housing 32 may be rotated about a generally upright axis which preferably is perpendicular to the laser reference plane 14 to be detected. A rotation mounting 106 may be interposed between the shock mount 36 and the lower plate 39 of the detector housing, the rotation mounting having a base 107 carrying a rotatable splined post 108 in bearing 109. The post 108 is matably attached to lower plate 39 by female splined coupling 120 or by other means known to the art, and the post 108 has a worm wheel 110 fixed to, coaxial with and encompassing the post. A worm gear 111 is rotatably supported by bearing 112 and connected through slip clutch 113 to motor 114. Rotation of the motor 114 turns the worm gear 111 to rotate the worm wheel 110 and rotatable post 108, thereby rotating the detector housing 32 about the central longitudinal axis of the post 108.

It is desirable that the angular velocity of the post 108 be substantially greater than the angular velocity of the rotating laser source 15, and it is preferred that the ratio be approximately two to one, assuring that any phase difference between the rotating laser source and the post 108 cannot prevent detection of the beam by the detector unit 191.

In the event the detector housing should be prevented from rotating, the slip clutch 113 protects the motor 114 from burnout. The motor 114 is connected through a switch 172 to the battery power supply of the vehicle 10, and the switch 172, which is positioned in the cab, is simply moved between on and off positions to start and stop, respectively, the motor 114. When the rotation mounting 106 is used with the detector housing 32, it is desirable that a set of slip rings and brushes or other type of rotatable contact be interposed adjacent the rotatable post 108 to interconnect the wires 80, 85, and 81 extending to motor 78 within the detector housing 32, and also to extend the wires 143 and 162 from the housing 32 to the plug 115. Since such coupling devices are readily available, it is deemed unnecessary to further describe them in this disclosure.

Electrical coupling 115 is provided on the rotation mounting 106 so that the cable 116 terminating in connector 117 and extending from the cab 16 may be easily connected and disconnected from the coupling 115 to permit the detector unit 191 and rotation mounting 106 to be removed for safe storage when the grader is unattended.

A pair of manually actuated clips 118 at opposed sides of the platform 34 has latches which engage hooks 119 on the rotation mounting 106 to keep the rotation mounting and the detector unit 191 safely in place on the shock mount 36. This coupling arrangement permits an operator to easily remove the detector unit 191 and rotation mounting 106 when the grader is unattended and to easily, securely reattach them for operation. In the event it is desired to use the detector unit 191 without the rotation mounting 106, the hooks 119 would be positioned in alternative position 132 at opposed sides of the lower plate 39.

Referring now to FIGS. 1 and 2, an outwardly extending platform 121 is rigidly fixed to cylinder 29 of the vehicle 10 and supports an easily removable circuit box 123. Preferably, the box 123 is attached to the platform 121 by clips similar to those already described for the connection of the detector unit 191 to the platform 34. This mounting arrangement permits the circuit box 123 to be removed for storage when the vehicle is unattended.

Within the circuit box 123 an incremental encoder 124 is operatively mounted and has a rotatable shaft 126 extending outwardly from the encoder and having the free end of the shaft supported in bearing 127. The shaft 126 is freely rotatable within predetermined angular extremes and has a tape reel 128 fixed to the shaft to rotate therewith, the tape reel having a spring loaded, extendable tape 129 coiled on the reel with remote free end 130 removably secured to a hook 131 on the underside of the platform 34. As the platform 34 is moved upwardly or downwardly in response to movement of the piston 30, the tape 129 on reel 128 unwinds and winds, respectively, keeping the tape 129 taut between the reel 128 and the hook 131. As the tape 129 winds and unwinds in response to movement of the detector unit 191 and platform 34, the shaft 126 of the encoder rotates, changing the angular position of the shaft 126.

The encoder 124 is a commercially available incremental shaft encoder characterized in that it generates an electrical grade signal containing a series of electrical pulses representative of the angular displacement of shaft 126. The incremental encoder is connectable to the battery power source 84 of the vehicle power supply to energize the encoder.

A binary coded decimal counter 133 is connected to the output of the encoder 124 to receive the electrical grade signals generated by the incremental encoder, the counter 133 serving as a conversion means by counting the pulses in the grade signal from the encoder and in response thereto generating a binary coded decimal output signal representative of the information contained in the encoder's grade signal. The binary coded decimal output of the counter 133 is electrically conducted to a digital display unit 135 positioned in the cab 16 of the vehicle. The encoder 124, tape 129 and tape reel 128, along with binary coded decimal counter 133, collectively comprise a measuring means for determining the distance between the tool and the detector unit. The counter 133 and display unit 135 are energized from the battery power source 84 of the vehicle power supply.

Because the encoder 124 is stationary relative to the vehicle 10 and because the tape 129 is movable in response to movement of the blade 12 or movement of the detector unit 191, the measuring means and display unit can be accurately calibrated to read the distance separating the lower edge 136 of the blade 12 and the center plane 101 of the detector. Accordingly, the operator in the cab 16 can by visual examination of the digital display unit 135 continually know the distance between the lower edge 136 of blade 12 and the laser reference plane, which will be approximately on the center plane 101 as will be described further hereafter, permitting the operator to accurately control the elevation of the blade during grading. Because the free end 130 of the tape 129 is easily detachable from the hook 131 and because the control box 123 may also be easily removed, the control box 123 and tape 129 may be removed from the vehicle for safe storage when the vehicle is unattended.

Figure 5:
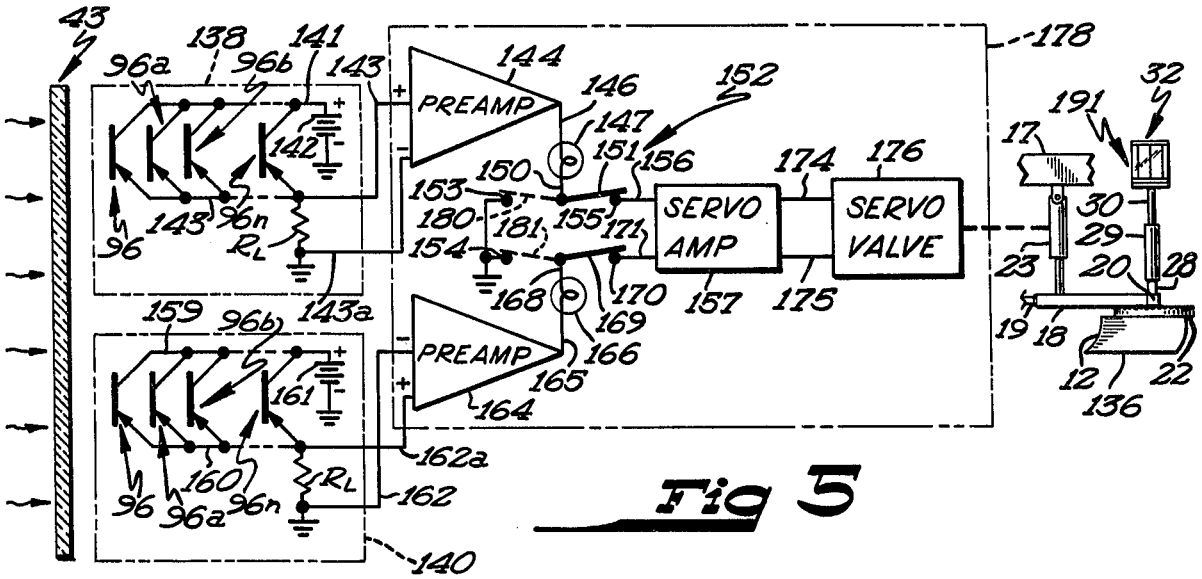
FIG. 5 is an electrical schematic diagram showing the electrical systems used with the detector unit of FIGS. 2, 6 and 8.

Referring now to FIG. 5, the first detecting array 138 has its plurality of phototransistors connected in parallel, as shown in the figure. Each of the phototransistors 96 serves as a switch which when closed permits current to flow from the battery power source 142 to the pre-amplifier 144. When struck by laser light, the first and second arrays become conducting and produce first and second control signals, respectively.

The preferred type of phototransistor 96 is a commercially available unit and is manufactured in groups of five transistors joined together and positioned along a common axis. Each phototransistor occupies approximately one-tenth inch as measured along the axis, and while the phototransistors are shown in groups of five on the first and second detecting arrays, it should be understood that a greater or lesser number of phototransistors could comprise each such group and is within the purview of the invention.

Best results have been obtained when all the phototransistors of each detecting array are connected in parallel with each other and in series with the battery power source 142 so that as the laser beam or plane 14 successively strikes each successively adjacent phototransistor such as transistors 96, *96a*, *96b*, and finally *96n*, the phototransistors become successively conducting, and each passes a short duration electrical pulse therethrough. The closely spaced phototransistors of each array, because connected in parallel, cause a longer duration output signal to be passed through the phototransistor array 138 or 140 than would occur if a lesser number of phototransistors comprised each array. Accordingly, the output from the five phototransistors of each group is approximately five times that which would occur if a single phototransistor were positioned on each face of the outer periphery 51. Naturally, the additional phototransistors on multiple faces of the outer periphery further increase the time duration of the output. This prolonged output signal through the phototransistors 96, *96a*, *96b*, *96n*, hereafter called a first signal, greatly increases the ease with which a visible and audible indication of laser beam reception can be produced, as will be described further hereafter.

Since the laser beam, as transmitted from laser source 15, which rotates at speeds up to 1200 rpm, will impinge on each phototransistor 96 for a very brief time interval, it is of great importance that each phototransistor have an extremely short rise and fall time in order to be responsive to the fast moving laser beam. Preferably, the phototransistors used in the first and second detecting arrays should have a rise and fall time on the order of three to four microseconds and for best results the planes 97 and 98 on which the phototransistors are centered should be parallel to the laser plane 14.

The positive terminal of the battery 142 is connected through conductor 141 to the phototransistors comprising the first detecting array 138, and the negative terminal of the battery is grounded. The first detecting array 138 is connected through conductor 143 to the input of preamplifier 144 and to the high end of load resistor $R_L$ which has its remaining terminal grounded and connected to the common ground of preamplifier 144 through conductor *143a*. The first control signal from the phototransistors, comprising positive voltage across resistor $R_L$ is applied to the preamplifier 144 for amplification and the first amplified control signal leaves the preamplifier 144 and is conducted along wire 146 to indicator lamp 147, which preferably is positioned in the cab 16 and is easily visible to the operator. A conductor 150 extends from the lamp 147 to the movable contact 151 of double-pole, double-throw switch 152, which has its terminals 153 and 154 commonly grounded. Terminal 155 of the switch 152 is connected through conductor 156 to an input terminal of servo amplifier 157. The prolonged nature of the first control signal from first array 138 assures a longer flash time of the indicator lamp 147 which comprises a perceptible indicating means for the operator to visibly confirm detection of the laser plane.

The second detecting array 140 has its phototransistors connected in parallel with each other with the collector terminals being connected to the positive terminal of battery 161 through conductor 159, the negative terminal of battery 161 being grounded. A conductor *162a* connects the phototransistors 96, *96a*, *96b*, *96n* of the array 140 to the high end of a load resistor $R_L$ and to the ground of preamplifier 164. The remaining terminal of resistor $R_L$ is grounded to earth ground and connected through conductor 162 to the input of the preamplifier 164. By obtaining the input of the preamplifier 164 from across the resistor $R_L$ with the shown connections, the input voltage from conductor 162 to conductor *162a* will be negative. The output of preamplifier 164 is connected to indicator lamp 166 through conductor 165. A conductor 168 connects the lamp 166 to movable contact 169 of switch 152. When contact 169 is in the shown full line position it contacts terminal 170, which is connected to servo amplifier 157 through conductor 171. The switch 152 is positioned in the cab 16. Accordingly, when switch 152 contacts terminal 170, the second control signal, comprising a negative voltage across resistor $R_L$, is delivered to amplifier 164 which produces an amplified second control signal and applies it to the indicator lamp and the servo amplifier 157.

The lamps 147 and 166 collectively comprise one type of indicating means usable with the invention to produce first and second indications perceptible to an operator that the first and second detecting arrays, respectively, have detected the laser plane. The term, lamps, as used herein refers to any light-emitting device and includes inter alia light-emitting diodes, neon tubes, etc. While visual indicating lamps have been used, it should be understood that other perceptible indications could be substituted and are within the purview of the invention. For example, the lamps could be replaced by meters, or by sound-generating equipment to provide an audible indication of beam detection. The prolonged signal from the detecting arrays, described earlier and resulting from use of a plurality of phototransistors, is useful in the generation of an audio signal of sufficient duration to be perceptible to an operator.

When the phototransistors of the first detecting array 138 are conducting, a positive voltage will be applied to the preamplifier 144 and to the servo amplifier 157 because the positive terminal of the battery 142 is connected to conductor 141. When the second detecting array 140 is conducting, a negative voltage will be applied to the preamplifier 164 and servo amplifier 157 because the low side of resistor $R_L$ is connected to conductor 162. The use of positive and negative voltages permits the servo amplifier 157 to readily determine which of the detecting arrays 138 or 140 is conducting at a given time. This information is of importance to permit the servo amplifier 157 to accomplish its purpose. The amplifier 157 further amplifies the first and second control signals from the preamplifier 144 and 164 and when a positive signal is received from the array 138, the servo amplifier 157 actuates servo valve 176 to cause the power device 23 to raise the draw bar and accordingly raise the detector unit 191. When a negative signal is received by the servo amplifier, it actuates the servo valve 176 to lower the blade 12 and accordingly to lower the detector unit 191. The servo amplifier 157 and servo valve 176 collectively comprise a servo mechanism electrically connected to the first and second amplifiers 144 and 164, respectively, and receives the amplified control signals from these amplifiers and in response actuates the hydraulic cylinder 23. Because such servo valves and servo amplifiers are well known in the art, it is deemed unnecessary to offer further explanation of their detailed construction.

The output of the servo amplifier 157 is connected through the conductors 174 and 175 to a commercially available servo valve 176. The servo valve 176 is coupled hydraulically to hydraulic cylinder 23 which raises and lowers the draw bar 18 of the vehicle 10. Accordingly, the servo valve 176 is constructed to actuate the hydraulic cylinder 23 to raise and lower the blade 12 or other tool toward and away from, respectively, the laser plane 14. Because the cylinder 29 which carries detector unit 191 is fixed relative to the blade 12 and moves upwardly and downwardly in response to blade movement, any movement of the blade in an upward or downward direction produces a corresponding and identical upward and downward movement of the detector unit 191.

The preamplifiers 144 and 164, indicator lamps 147 and 166, switch 152, servo amplifier 157, servo valve 176 and the shown conductors interconnecting the recited components with each other and with the detecting arrays comprise one type of electrical control circuitry 178 useable with the invention to receive the first and second control signals from the arrays and in response thereto to actuate the power device 23 to move the tool 12 and with it the detector housing 32 so that the detector comprised of the arrays 138 and 140 can follow the laser plane 14 and keep the plane 14 between the arrays.

When it is desired that the blade be operated only manually and not be responsive to the servo amplifier and valve, the servo amplifier 157 and servo valve 176 can be removed from the electrical control circuitry 178; to do so the switch 152 is actuated such that the movable contacts are in positions 180 and 181. When the switch arms are in position 180 and 181 contacting terminals 153 and 154, respectively, conductors 150 and 168 are grounded to thereby remove the servo amplifier and valve from the circuit 178. The indicator lamps 147 and 166 will continue to respond as the upper and lower detecting arrays 138 and 140, respectively, are actuated by laser light.

In operation, the operator first determines the acceptable error tolerance by which the grade level can vary from the preferred elevation to be established by the grader 10. For example, if coarse grading is being done, perhaps the grade can vary by as much as three inches. If so, the operator positions the first and second carriages 48 and 49 such that the distance of separation between the common planes 97 and 98 is three inches. To obtain this separation, the operator energizes switch 83 in the cab 16. Assuming that the first and second carriages are in fully converged position 93 (FIG. 4), the operator swings the switch 83 from position 182 (FIG. 2), to position 183, permitting current to flow from battery 84 through switch 83 and along conductor 81 to the electric motor 78 to rotate it in a forward direction. Forward rotation of motor 78 is transmitted through slip clutch 76 to rotate the threaded shaft 72 with its left-and right-hand threads 73 and 74, causing the threaded sleeves 69 and 70 to diverge, carrying the first and second carriages 48 and 49 away from one another. The unthreaded collars 92 move smoothly, freely along the guide rods 88 and 90, guiding the first and second carriages during diverging and converging movement. As the carriages diverge, the operator may observe the length of graduated post 99 appearing above plate 38, and when the graduations indicate that the planes 97 and 98 of the carriages are three inches apart, the operator opens switch 83 by swinging the moving contact to terminal 87 to turn off motor 78.

If it is necessary to further converge or diverge the carriages to correct the positioning of the carriages, the operator, to converge the carriages, simply swings the switch 83 to position 184, permitting current to flow from the battery 84 through switch 83 and along conductor 85 to motor 78 to produce reverse rotation of the motor 78. Current leaving the motor 78 returns to ground through conductor 80. Reverse rotation of motor 78 causes reverse rotation of shaft 72 and accordingly, the right-hand and left-hand threaded sleeves 69 and 70, respectively, converge, carrying the upper and lower carriages toward one another. When the carriages meet in fully converged position 93, slip clutch 76 will undergo slippage, thereby eliminating any danger of burnout of the motor 78.

If desired, a microswitch or other automatic cutoff switch may be connected in series in the conductor 85 and positioned along the path of the carriages to cause the switch to be opened when the carriages reach the fully converged position 93, to automatically turn off the motor 78. Similarly, an automatic cutoff switch may be connected in series with conductor 81 and positioned adjacent the upper or lower plate 38 or 39 to be actuated and opened by a carriage as it reaches fully diverged position 94.

The operator next ascertains that the laser reference plane 14 has been established by the laser beam source 15. The operator manually opens switch 152, swinging it to an off position where the movable contacts are in positions 180 and 181 to thereby temporarily disconnect the servo amplifier 157 from the remainder of circuit 178. With the switch 152 in the described off position, the indicator lamps 147 and 166 are still operational and will flash when the first and second detecting arrays 138 and 140, respectively, detect the laser plane 14.

The operator next determines from blueprints, specifications sheets or the like the grade distance below the laser plane 14 at which he wishes the lower edge 136 of the blade 12 to be positioned. For example, if the grade distance is 12 feet, the operator manually actuates the hydraulic cylinder 29 to raise piston 30 to thereby create a distance of separation of 12 feet between the lower edge 136 of the blade 12 and the center plane 101 of the detector. The operator easily determines when this grade distance has been achieved by observing the distance of separation on the digital display unit 135 positioned in the cab 16. The details of operation of the encoder 124, counter 133 and display 135 will be discussed at a later point in this description.

As the next step the operator alters the elevation of the blade 12 so the detector unit 191 is moved to a position where the detecting arrays will be on opposite sides of the laser reference plane 14. To so position the unit 191, the operator actuates the cylinder 23 to first raise the blade 12 a few inches, causing the post 28, cylinder 29, piston 30 and platform 34 to rise, carrying the first and second detecting arrays upwardly in the direction of arrow 185 (FIGS. 1 and 2). Assuming that the first or upper detecting array 138 was situated below the laser reference plane 14, the phototransistors of the upper detecting array 138 will contact the laser plane 14 before those of the lower array 140. As the laser plane 14 strikes the optical filter 43, it passes through the filter with minimal attenuation while ambient light, such as sunlight, is substantially attenuated and prevented from reaching the detecting arrays 138 and 140. The laser light frequencies which pass through the filter 43 strike one or more of the phototransistors 96 of upper detecting array 138, causing such transistors to become conducting so long as the beam impinges thereon. During the interval in which such phototransistors 96 are conducting, the conducting phototransistors become, in effect, a closed switch, and current flows from the battery 142 through the actuated phototransistors 96 and through resistor $R_L$ to ground. The voltage drop across resistor $R_L$ is applied to the preamplifier and comprises the first control signal described earlier. Current flows along conductor 143 to preamplifier 144, where the voltage across resistor $R_L$ is amplified and applied to the indicator lamp 147, after which the current flows along conductor 150 and through switch 152, which is in position 180, to terminal 153 which is grounded. Accordingly, when one or more phototransistors of the first detecting array 138 are made conducting by the laser beam, the indicator lamp 147 within the cab 16 flashes to alert the operator that the upper detecting array 138 has detected the laser plane 14.

The operator now continues to actuate the hydraulic cylinder 23 to further raise the blade 12 and the detector unit 191 until the second or lower detecting array 140 contacts the laser plane 14. When the detecting array 140 reaches the level of the laser plane 14 one or more of the phototransistors 96 of the array 140 will be made conducting by the beam and become, in effect, closed switches which permit the flow of current from battery 161, along conductor 159, through the phototransistors 96 which are conducting and to conductor 160. Current flows from conductor 160 through resistor $R_L$ to ground. The frequency dependent characteristics of the filter 43, described earlier, remove ambient light frequencies which might otherwise reach the array 140 and accordingly ambient light has little effect on either array. In addition, since each array is relatively unresponsive to ambient light frequencies, the import of ambient light is further diminished. The voltage across resistor $R_L$ is a negative voltage and comprises the second control signal. It is applied to the preamplifier 164 and amplified, after which the amplified voltage is applied to indicator lamp 166, current flowing along conductor 165 to the lamp 166 and then along conductor 168 and through switch 152 to terminal 154 to ground. As the lamp 166, which is located in the cab 16, is actuated, it flashes so as to provide a visible indication to the operator that the detecting array 140 has encountered the laser plane 14. The operator now actuates hydraulic cylinder 23 to lower the blade 12 in direction 186, causing the detector unit 191 to move in the downward direction 186. The operator permits only a slight amount of downward movement so as to position the laser plane 14 between the first and second detecting arrays 138 and 140, respectively. The lower edge 136 is now at the preferred predetermined distance from the laser plane within an acceptable error tolerance, which happens to be three inches in the example used herein.

The operator next swings the switch 152 until the movable contacts are in closed positions 151 and 169 (FIG. 5). In these closed positions the detector unit 191 will follow the laser plane 14 as the vehicle 10 moves across the land surface to be graded, as will now be described in detail.

So long as the grader 10 remains on terrain having substantially the same elevation as that at which the grader started, the laser plane 14 will remain positioned between the upper and lower detecting arrays 138 and 140, respectively, and no movement of the blade 12 or the detector unit 191 is needed in order to maintain the blade 12 at the desired grade level or to keep the detector unit 191 in touch with the laser plane 14.

As the land surface along which the vehicle 10 is moving begins to decrease in elevation, increasing the distance separating the lower edge 136 of the blade 12 and the laser reference plane 14, the phototransistors transistors of the upper detecting array 138 will be struck by the laser plane 14 and will become conducting. As the phototransistors of the first detecting array 138 become conducting, current flows from the battery 142, along conductor 141, through the phototransistors to conductor 143 and thence to preamplifier 144. The positive voltage across resistor $R_L$ is applied to the preamplifier 144, is amplified and the amplified signal then applied to the indicating lamp 147. Current leaves lamp 147 and flows along conductor 150, through switch 152 to conductor 156 and into servo amplifier 157, which receives its power from the vehicle power source (not shown).

The first control signal, now amplified, is by its positive nature easily recognized by the servo amplifier and in response the servo amplifier 157 electrically actuates the servo valve 176, causing the servo valve to energize cylinder 23 to raise the blade 12 in direction 185. This upward movement raises the detector unit 191, moving the upper or first detecting array 138 upwardly. The servo valve 176 powered from the vehicle power source (not shown) continues to operate the cylinder 23 until the detector unit 191 has moved upwardly sufficiently to bring the first detecting array 138 above the laser plane 14 until the detecting array 138 ceases to be conducting. When the laser beam is no longer incident on the phototransistors of upper detecting array 138, the transistors cease conducting and no first control signal is applied to the servo amplifier 157. When the servo amplifier 157 no longer receives the control signal, the amplifier 157 stops actuating the servo valve 176, and accordingly the cylinder 23 stops raising the blade 12 and the detector unit 191. The blade is now at a higher level relative to the vehicle and the blade's depth of cut is decreased. The lower edge 136 of the blade is still the preset predetermined distance below the center plane 101 and the laser plane is between the first and second detecting arrays.

As the land surface increases in elevation, reducing the distance separating the lower edge 136 of the blade 12 and the laser reference plane 14, the phototransistors of the lower detecting array 140 will be struck by the laser plane 14 and will become conducting. As any of the phototransistors 96, 96*a*, 96*b*, etc. of the array 140 become conducting, the negative voltage across resistor $R_L$, which comprises the already described second electrical control signal, is applied to the preamplifier 164; a current flow from the battery 161 to conductor 159, through the laser light actuated, conducting phototransistors, and through resistor $R_L$ to conductor 162 and preamplifier 164. This second control signal applied to preamplifier 164 is amplified to a higher level and output current leaving the preamplifier 164 flows along conductor 165 to energize the indicating lamp 166, after which it flows along conductor 168 through switch 152, and along conductor 171 to the servo amplifier 157.

The servo amplifier 157 recognizes the negative voltage of the second control signal and in response energizes the servo valve 176 to actuate hydraulic cylinder 23 to lower the blade 12. So long as the lower detecting array 140 is actuated by the laser plane, the servo amplifier 157 continues to signal the servo valve, causing it to continue actuating cylinder 23 to lower the blade 12. As the blade 12 is lowered, the upright mast moves downwardly with it, carrying the detector unit 191 to a lower level unit the lower detecting array 140 is again below and out of the laser plane 14. Since the detecting array 140 is no longer in the laser plane, it becomes non-conducting and current from battery 161 no longer flows through the array. Accordingly, the second control signal ceases and the servo amplifier 157 no longer actuates the servo valve 176; cylinder 23 stops its downward movement. The lowering of the blade relative to the vehicle 10 results in the blade cutting more deeply into the earth to lower the grade level of the earth to the desired elevation.

The display component 135 positioned in the cab provides the operator with a continual digital readout indicating the distance between the lower edge 136 of the blade 12 and the center plane 101 to provide a continual reminder to him of the elevation at which the tool is working, and specifically the distance from the laser plane 14 at which the tool 12 is operating.

The encoder 124 is fixed to the platform 121 with its extendable tape 129 detachably carried by the hook 131 on the lower side of the platform 34. Accordingly, upward and downward movement of the piston 30 is directions 185 or 186, respectively, causes the tape 129 to be pulled upwardly and out of or pushed downwardly and into, respectively, the reel 128 of the encoder. As the tape is extended from or retracts to the reel 128, the shaft 126 of the encoder 124 rotates in a forward or rearward direction, respectively, and its angular displacement is thus completely dependent on the distance of separation between the reel and the platform 34. For each angular position of the shaft 126, the encoder 124 produces a distinct output signal comprising a number of electrical pulses which are delivered to binary coded decimal counter 133, which in response to the number of pulses received from the encoder 124 generates a binary coded decimal signal which is delivered to digital display 135. The encoder 124, counter 133 and display 135 are energized by batteries or by the vehicle power source, but a graphic designation of such power connections has been omitted from the drawings in the interest of simplification.

The display 135 includes a driving circuit and a memory register, the memory register retaining an incoming BCD signal until a new BCD signal is delivered from the counter 133. The driving circuit provides operating voltages to light the preferred light-emitting diode type display. The display also includes means for calibrating the display output including means for adding a constant to the display to calibrate it. It should be noted that the display if uncalibrated would simply read the distance between the position at which the encoder is mounted on the cylinder and the position at which the end of the tape joins the platform 34. Because it is desired to read the distance between the plane 101 and the lower edge 136 of the blade 12, the display is calibrated by adding an additional increment to the value received from the counter 133, the value representing the additional amount of distance between the platform 34 and the plane 101 and also the additional distance between the encoder shaft and the lower edge 136 of the blade. Accordingly, with these added increments the operator can read the display 135 and obtain the distance separating the plane 101 and the lower edge 136 of the blade 12.

In the foregoing description of the detector unit 191 and its operation, it has been presumed that the optical filter side of housing 32 has been facing the laser beam source 15 or has been in an orientation in which one or more faces 44, 45, 46 or 47 is confronting the laser source sufficiently for the phototransistors 96 behind one or more of the four faces to receive and detect the laser plane 14. During some grading operations, it may be unnecessary to rotate the detector unit 191, but in most situations it is necessary to at least swing the unit 191 somewhat for one or more of the faces to confront the laser source 15. To do so, the operator actuates switch 172 in cab 16 to energize the motor 114. As the motor 114 begins turning, its rotation is transferred through slip clutch 113 to shaft 111. The worm gear 111 rotates worm wheel 110, causing the rotatable post 108 to begin rotation in its bearing 109, turning coupling 120 of detector unit 191 relative to the rotation mounting 106.

The switch 172 may be a simple off-on type to energize the motor 114. Alternatively, the switch may be provided with a rheostat to provide one or more speeds to permit the operator to slowly rotate the detector unit 191 or alternatively to rotate the unit at high speed. A slow rate of rotation may be helpful if the faces 44–47 are simply to be directed toward the laser source 15. Alternatively, if high speed rotation is to be used, it is desired that the housing rotate at a speed of approximately twice that of the rate of rotation of laser beam source 15. This assures that the rotating detector housing 32 and the rotating laser source 15 will not assume an out-of phase relationship such that the laser plane strikes the detector housing at a time when none of the faces 44–47 are in a position where they can receive the beam.

Figure 6:
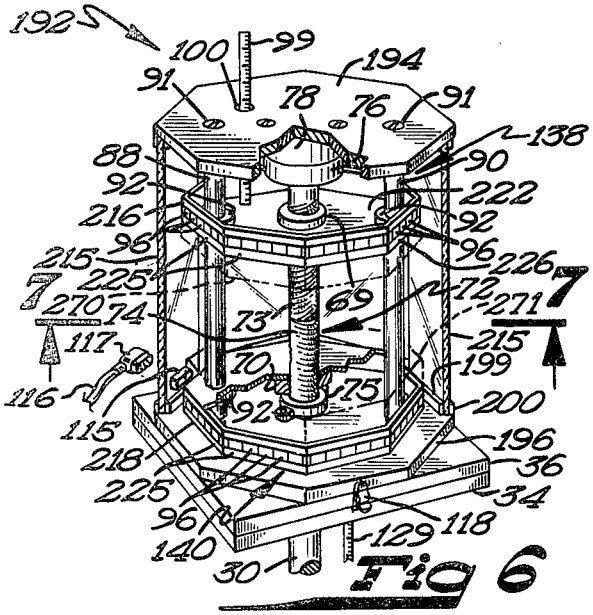
FIG. 6 is a perspective view of a second embodiment of a detector unit usable with the invention.
Figure 7:
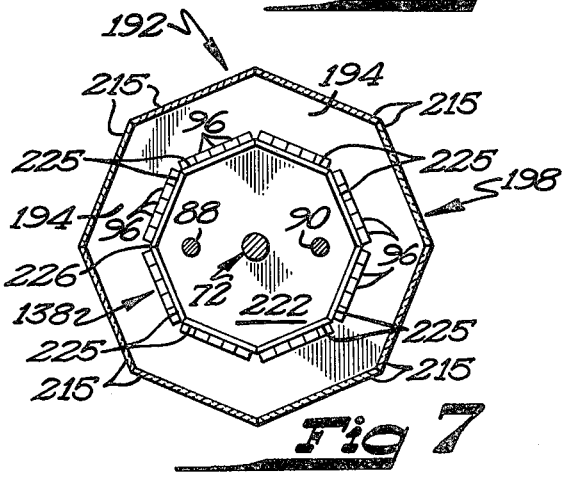
FIG. 7 is a cross-sectional bottom view of the detector unit of FIG. 6 taken in the direction of cutting plane 7—7.

Referring now to FIGS. 6 and 7, a second embodiment 192 of a detector unit is shown which has a generally octagonal cross section. The detector unit 192, which may be used substantially interchangeably with the detector unit 191 of FIG. 2, is responsive to laser beams through a 360° arc centered on circle 72 of FIG. 7, and accordingly need not be rotated. For this reason, the rotation mounting 106 would not be needed with the detector unit 192, which is carried directly on the shock mounting 36 already described in conjunction with detector unit 191 and may simply be substituted for the unit 191.

The unit 192 has upper and lower, generally parallel, spaced apart plates 194 and 196, respectively, whose outer circumference is eight-sided and has the shape of a regular octagon. An optical filter 198 has eight generally identical and adjoining faces 215 which extend between the upper and lower plates, being retained by the inner and outer lips 199 and 200 in the same fashion as that of the already described detector unit 191 of FIG. 2. Aside from having the cross section of a regular octagon, optical filter 198 is constructed in the same manner as the filter 43 of FIG. 2 and permits light frequencies generated by the laser source to pass therethrough but substantially attenuates ambient light frequencies. The upper and lower plates and the filter 198 collectively comprise the detector housing of the unit 192.

Attached to the upper plate 194 is a carriage drive means in the form of a reversible electric motor 78 coupled through a slip clutch 76 to threaded shaft 72 having right- and left-hand threads 73 and 74, respectively. The lower end of the shaft 72 is rotatably journaled in bearing 75.

Guide rods 88 and 90 extend between the upper and lower plates 194 and 196 and are rigidly secured thereto by mounting screws 91.

First and second substantially identical carriages 216 and 218, respectively, are mounted on guide rods 88 and 90 and also on threaded rod 72 for converging and diverging movement, as already described in detail for the detector unit 191. The carriages 216 and 218 each have a pair of collars 92 which are slidably mounted on the rods 88 and 90 and fixed to the base plate 222 of a carriage. The rods 88 and 90, along with collars 92, comprise a guide means for defining the path of the carriages. Threaded sleeves 69 and 70 are fixed to the base plate 222 of carriages 216 and 218, respectively, and threadably engage the left-and right-hand threads, respectively, of shaft 72. The sleeve 69 carries a left-hand thread and the remaining sleeve 70 a right-hand thread so that the carriage diverge and converge in response to forward and rearward rotation of the shaft 72, as was the case for the carriages 48 and 49 of the detector unit 191. The first and second carriages, guide rods 212 and 214 and unthreaded collars 92 collectively comprise a detector support frame for the unit 192.

Each of the carriages 216 and 218 has an outer periphery 226 which is generaly octagonal in cross section, as shown in FIG. 7, specifically being a regular octagon. Each of the eight faces 225 is substantially identical and is parallel to and confronts a face 215 of the optical filter 198 to diminish reflectivity and maximize reception, as was described in conjunction with the detector unit 191.

Each of the faces 225 of the carriages 216 and 218 has a plurality of the phototransistors 96 mounted thereon, it being preferred that a group of five closely spaced phototransistors 96 be mounted on each face, the phototransistors being centered on common planes 97 and 98 (FIG. 4) just as was the case for the detector unit 191. The phototransistors selected should have the same characteristics as those described in conjunction with the detector unit 191 and should be matched to the optical characteristics of the filter 198, as described in conjunction with the unit 191.

A measuring post 99 extends upwardly from the upper carriage 216 through an aperture 100, as was the case for the detector unit 191. Although the particular electrical connections usable for the detector 192 have been omitted from FIG. 6 for simplification, it should be understood that the connections are substantially identical to those in FIG. 2 with the exception that no rotation mounting 106 is required, since the detector unit 194 need not be rotated and is attached to the shock mounting 36 by clips 118. All phototransistors on the first carriage 216 are connected in parallel as was the case for unit 191 and collectively comprise the first detecting array 138 (FIGS. 5 and 6). All phototransistors on the second carriage 218 are also connected in parallel and comprise a second detecting array 140 (FIGS. 5 and 6). The first and second detecting arrays 138 and 140 comprise the detector and are positioned about the outer peripheries of the first and second carriages to face outwardly in a plurality of directions. The control circuitry 178 of FIG. 5 is connected with the detecting arrays of the unit 192 in exactly the same manner as was the case for unit 191 and operates with the unit 192 as described earlier in conjunction with the detector unit 191.

Because the detector unit 192 is substantially identical to the detector unit 191 of FIG. 2 except that the detector 192 has a filter 198 and carriages 216 and 218 having octagonal cross sections, it is deemed unnecessary to provide extensive description concerning its operation. Like the detector unit 191, the detector unit 192 has first and second carriages which converge and diverge in response to rotation of the reversible electric motor 202 and have their plurality of phototransistors centered on common, generally parallel planes 97 and 98. The carriages are movable between fully converged position 93 and fully diverged position 94 with various intermediate positions such as 270 and 271. Operation of unit 192 is identical to that described for unit 191, aside from the fact that the detector of the unit 192 is responsive to laser beams through a 360° arc.

Referring now to FIG. 8, a third embodiment 228 of a detector unit is shown. The detector 228 is substantially identical to the detector 192 except that it is generally elliptical in cross section, the preferred type of ellipse being a circle, and the first and second carriages 230 and 232 are concentric with the ellipse of the filter 240, and preferably have generally cylindrical outer peripheries 234 with a common central longitudinal axis perpendicular to the planes 97 and 98 on which the phototransistors are centered, as described hereafter.

The shown detector unit 228 has generally circular upper and lower plates 236 and 238. The plates are interconnected by guide rods 88 and 90 and threaded shaft 72, as was the case for the detectors 191 and 192 and have been numbered with the same numbers used for corresponding parts of unit 191. The upper and lower plates 236 and 238, respectively, retain the generally circular cross sectional optical filter 240 therebetween which has the same optical properties described for filters 43 and 198.

The generally cylindrical outer peripheries 234 of the first and second carriages 230 and 232, respectively, support thereon a plurality of closely spaced phototransistors 96 electrically alike those already described for units 191 and 192 but formed with an inherent radius of curvature equal to the radius of curvature of the outer periphery 234. These phototransistors or equivalent photosensitive devices extend substantially completely about the outer peripheries of the carriages 230 and 232. The plurality of phototransistors 96 on the first carriage 230 defines a first laser beam detecting array 138 which is responsive to a laser beam incident on the carriage through a full 360° are centered on the shaft 72. Similarly the plurality of phototransistors on the second carriage 232 comprises an equally responsive second laser beam detecting array 140. The first and second arrays collectively comprise a laser reference plane detector.

The upper and lower plates 236 and 238 along with the filter 240 comprise a detector housing for containment of a detector support frame comprised of the carriages 230 and 232, the guide rods 88 and 90, and collars 92 fixed to the carriages. As described earlier, the rods 88 and 90 comprise guide means for determining a path along which the carriages converge and diverge relative to one another. The motor 78 and clutch 76, along with shaft 72 and bearing 75, comprise a carriage drive means by which the carriages 230 and 232 may be converged and diverged.

All of the phototransistors 96 making up the first detecting array and located on the first carriage 230 are centered on a common plane 97 (FIG. 4); all of the phototransistors defining the second detecting array of the carriage 232 are centered on the common plane 98, the planes 97 and 98 being parallel. During operation the first and second arrays are electrically connected with the control circuitry 178. The carriages 230 and 232 are movable between fully converged position 93 and fully diverged position 94 by means of rotation of shaft 72 by the reversible electric motor 78 and the clutch 76. Because the detector unit 228 is responsive to laser light through a 360° arc, it is unnecessary to rotate it, and accordingly a rotation mounting 106 would not be used with it. In all other respects the detector unit 228 operates identically to the detector unit 192 of FIGS. 6 and 7 and would be used with the grader 10 and raised and lowered by cylinder 29.

While the description of the first, second and third detector unit embodiments 191, 192 and 228, respectively, and their operation have been described in conjunction with a laser plane 14 which has been shown as being generally horizontal, it should be understood that the laser plane 14 may be inclined to the horizontal to establish a particular desired slope for the vehicle 10 or alternatively the laser plane may be an upright, generally vertical plane. It should be understood that with minor modifications the invention can function equally well with such alternatively oriented planes and that use of the invention will alternatively positioned planes is within the purview of the invention.

For example, if it were desired to use a generally vertical plane in order to guide the vehicle 10 on a straight line course or alternatively to guide a trenching machine vehicle along a straight line course, the hydraulic cylinder 29 could be positioned horizontally to move the detector toward and away from the generally vertical plane and follow the vertical laser plane in accord with the teachings presented herein. It is not essential that any of the detector units shown herein be attached directly to or carried by the tool 12 or its crossbar 20 as shown in FIG. 1. It is desirable, however, that the detector unit move in response to tool movement so that the predetermined desired distance of separation between the plane 101 of the detector unit and the tool may be maintained.

While the detector housing 32 is shown as being carried by a mounting 26 comprised of cylinder 29, platforms 34 and 36 and post 28 which are fixed to and carried by the tool 12, it should be understood that it is not essential that the mounting be connected directly to the tool 12 or its hardware. It is only required that the mounting 26 move the detector unit in response to tool movement to retain the desired predetermined distance between tool and plane 101 of the detector unit. For example, it is within the purview of the invention that a cylinder like cylinder 29 be mounted instead to the roof of the cab or elsewhere but not attached directly to the tool 12. By such alternative mounting, vibration associated with the blade 12 is further isolated from the detector unit. With such an alternative positioning on the cab roof, the cylinder 29 could be carried by a slave cylinder whose movement would raise and lower the cylinder 29 and whose movement would be directly proportional on a one-to-one basis to movement of a master cylinder attached to the tool 12 and which moved in response to tool movement to transfer an equivalent amount of movement from the master cylinder to the slave cylinder on the roof of the cab. While hydraulic cylinders are preferred for the anticipated construction work with which the invention is associated, it should be understood that any fluidically actuated cylinder, such as a pneumatic cylinder, may be used with the invention and is within the purview of the invention.

If desired a pendulum mount or other leveling apparatus (not shown) may be provided to keep the mounting 26 in a vertical orientation when the blade has a non-zero slope. The post 28 is then detached from or pivotally mounted to the cross bar 20, or the mounting 26 may be located on the roof of the cab or elsewhere as described above. Under some circumstances it is useful to have the cylinder retained in a vertical orientation and any appropriate leveling device known to the art may be used with the shown mounting 26 to produce such vertical orientation.

While the invention has been shown as being used on a road grader, it should be understood that it may be used on other tool carrying vehicles such as bulldozers, trenching machines, curb-laying apparatuses or the like, and the term vehicle is intended to encompass all such alternative structures and others on which it would be apparent to one skilled in the art to use the invention. Naturally, the invention may also use tools other than grading blades to control the position relative to a laser reference plane at which a tool should function.

Figure 9:
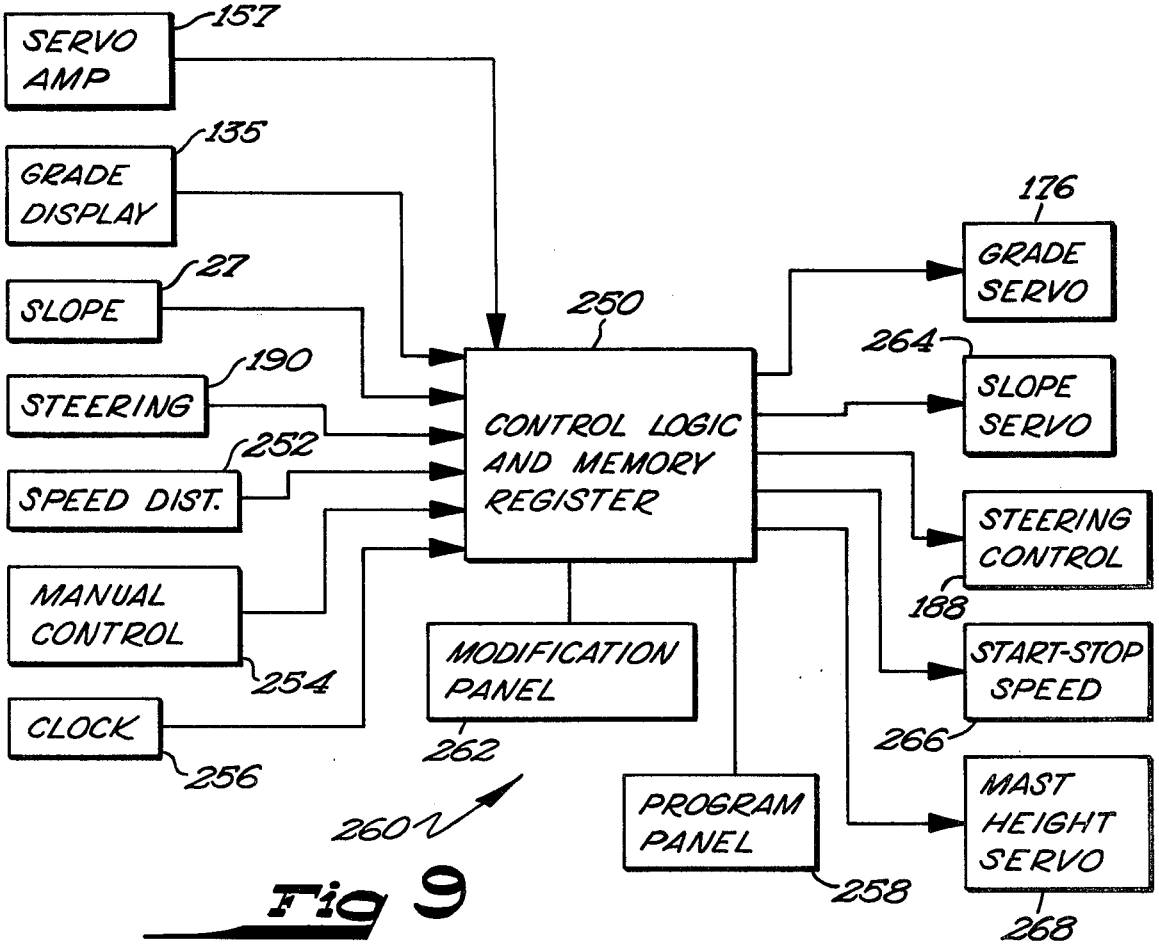
FIG. 9 is a flow diagram showing the components of a computer controlled system for actuating the tool carrying vehicle of FIG. 1.

Referring now to FIGS. 1 and 9, the already described apparatus for maintaining a predetermined distance between the blade 12 and a laser reference plane 101 may be combined with other systems which permit further control of the vehicle 10 and the directing of movement of the tool 12 in accordance with a predetermined computer program. Referring now to FIG. 9, a computer 250 including appropriate control logic and memory register systems is electrically connected to the digital display 135 and receives the binary coded decimal signal generated by the counter 133. Accordingly, the computer is provided with information indicating the instantaneous distance between the lower edge 136 of the blade 12 and the center plane 101 which is within a known distance of the laser plane 14, the known distance being that distance separating planes 97 and 98 of the detector.

The output of the servo amplifier 157 is connected to the computer to provide information as to when the servo amplifier is actuating the servo valve 176 and whether the drawbar is raised or lowered as a result of servo valve movement. By having the computer record activity of the servo amplifier as a function of time or distance, the project engineer can by study of its activity easily isolate land areas where the ground is highly irregular or rocky by noting excessive activity of the servo amplifier 157. Special planning can then be focused on such land areas.

The slope sensing device 27 (FIG. 1) generates an electrical slope signal and is electrically connected to the computer 250 to thereby provide the computer with information indicating the inclination of the blade 12 relative to the horizontal.

The steering sensor 190 is positioned on the steering system of the vehicle 10, preferably being on the steering shaft 251, and generates an electrical steering signal indicating the position of the steering system. The sensor 190 is electrically connected to the computer 250 to deliver the steering signal to the computer 250, providing continuous information as to the position in which the steering system is situated. This information permits the computer to control the direction in which the vehicle 10 will travel and, specifically, to compare the actual position of the steering system with a preferred position defined by the computer program, as will be described further hereafter.

A speed and distance sensor 252 is incorporated in the speedometer and odometer, respectively, of the vehicle 10 and electrically connected to the computer 250 in order to provide input information to the computer 250 of the speed of the vehicle and the distance the vehicle has traveled from a predetermined starting point. Accordingly, the device 252 provides a position indicating means and generates an electrical position signal indicating the position of the vehicle in a given geographic area and relative to a reference point.

A manual control switch 254 permits an operator to deactivate the computer controlled system 250 and resort to manual operation of the vehicle's controls when the situation requires. Such as override device can be extremely valuable when unpredictable terrain is encountered and it is necessary that the operator control the vehicle 10 in accord with existing conditions rather than letting the computer 250 actuate the vehicle in accord with a preconceived computer program.

A clock 256 is electrically connected with the computer 250 to provide a time base for the computer, permitting the computer to perform operations as a function of time and permitting the computer to make time based comparisons.

A program panel 258 is electrically connected to the computer 250 and constructed to accept a punch card system of programming, or alternatively utilize a tape cassette program, either of which programming techniques may be utilized by a project engineer to provide computer programs which the computer 250 may follow on a day-to-day basis. It is contemplated, for example, that the system 260 would have utility in the construction of modern highways where the roadbed follows a predetermined, mathematically predictable course known to the project engineer through blueprints indicating the road elevation and road path for a given land surface. The construction project data may be converted to program form using relay ladder diagrams, Boolean equations or the like. If desired, a program written in the well-known Fortran IV may be utilized. The project engineer can in advance write a workable computer program for each day's work plan and use it to program the computer 250 to have grader 10 perform grading operations, raising and lowering the tool as necessary to control elevation as a function of position along the road under construction.

A modification panel 262 is provided to permit easy modifying of the computer program used in conjunction with the program panel 258. The panel 262 may also be provided with peripheral equipment, recorders, etc. for monitoring the operation of the system 260, if desired.

The grade servo valve 176, described earlier, may be electrically connected with the computer 250 to permit the computer to actuate the servo valve 176 which is hydraulically coupled to the hydraulic cylinder 23, permitting moving of the hydraulic cylinder 28 to raise and lower the blade 12 or other tool on the vehicle 10.

The computer 250 compares the grade signal from the display 135 with the desired elevation of the tool 12 as established by the computer program of panel 258, and then actuates the grade servo valve 176 until the tool is at an elevation in accord with the computer program.

A slope servo valve 264 is electrically connected to the computer 250 and provides a tool slope controlling means. The valve 264, when actuated by the computer, causes the slope cylinders 24 and 25 to extend and retract as needed to alter the slope of the blade 12. The computer 250 accepts information from the slope sensor 27 indicating the instantaneous slope of the blade 12, compares the information with the preferred slope of the blade as established by the computer program, and then actuates the slope servo valve 264 to extend and retract cylinders 24 and 25 to move the blade until it occupies a position in accord with the computer program.

A steering control apparatus 188 is positioned on the vehicle and is electrically connected to the computer to receive control signals from the computer 250 to move the steering device 251 to control the direction of the vehicle in accord with the computer program, thereby directing the vehicle along a path established by the program.

A start-stop-speed control device 266 is electrically connected to the computer 250 to permit the computer to actuate the device 266. The device 266 is responsive to computer control signals to start the vehicle 10, stop it, and to control the speed at which it travels. The computer receives information from speed-distance sensor 252 showing actual speed of the vehicle, compares the actual speed with the desired speed as contained in the computer program, and actuates the start-stop-speed control device 266 to maintain the preferred speed in accordance with the program.

A mast height servo valve 268 is electrically connected to the computer 250 for actuation by the computer and when actuated causes the cylinder 29 to retract or to extend to thereby control the distance separating the detector unit 191, 192 or 228 and the blade 12. The computer 250 accepts information signals from the display 135 to inform the computer of the distance separating the detector unit and the blade 12, compares the distance with the preferred distance established by the computer program, and actuates the mast height servo valve 268 to establish the required distance of separation in accord with the computer program.

Accordingly, the computer controlled system 260 permits an operator to utilize a predetermined computer program with the computer 250, with the computer accepting input information as to the distance separating the detector unit and the blade 12, the slope of the blade 12, the position of the steering device 251 on the vehicle, the speed of the vehicle and the distance traveled from a starting point by the vehicle, and to compare these input data with the required preset parameters of the computer program. The computer can then actuate the various servo systems 176, 264, 188, 266 and 268 to control the course of the vehicle 10 over a land surface and to position the blade 12 or other tool in the best and optimum arrangement for each point along the course traveled by the vehicle 10.

The computer controlled system 260 has particular utility for grading of highway construction projects and is particularly useful when the path to be graded is curving and the land surface irregular. For example, in the grading of S-type curves, the present practice is to grade a predetermined distance, change the slope of the blade to bank the curve, grade an additional distance, again change the slope of the blade for further banking needed to compensate for greater or lesser curvature, and to continue this technique until the curve has been satisfactorily completed. With the system 260, the computer 250 can be programmed to continuously and accurately adjust the elevation and slope of the blade 12 or other tool as a function of the distance traveled through the curve on the road's path. The old system of approximating preferred slope and elevation by manual, stepped changes in blade position can be replaced by the invention to permit close control of the blade, assuring grading closely in accord with a predetermined computer program. When unpredicted terrain features appear, the operator can place the system on manual control, or alternatively if time permits insert a modified or alternative computer program in the panel 262 to adjust to the contingency.

While the preferred embodiments of the present invention have been described, it should be understood that various changes, adaptations and modifications may be made therein without departing from the spirit of the invention and the scope of the appended claims.

What is claimed is:

1. In combination with a vehicle having a power supply and movable over a given land surface and having a tool attached to the vehicle and movable toward and away from a laser reference plane generated by a swinging laser beam, and further including a power device carried by the vehicle, energizable by the power supply, and operatively connected with said tool to move said tool toward and away from the laser reference plane, an apparatus for maintaining a predetermined distance between said tool and the laser reference plane comprising:

a detector housing;

a detector support frame carried by said detector housing and having an outer periphery facing outwardly from said housing;

a laser reference plane detector carried by said detector support frame and energizable by the power supply, said detector including first and second laser beam detecting arrays, each said array including at least one light-sensitive device attached to said outer periphery of said detector support frame, said light-sensigive device of each array substantially centered on a common plane, with the common planes of said first and second arrays being generally parallel to and spaced from one another to define a zone therebetween, said first and second arrays producing first and second control signals, respectively, in response to detecting the laser reference plane;

a mounting carried by said vehicle and supporting said detector housing such that said zone is said predetermined distance from said tool, said mounting being movable relative to said vehicle to move said detector housing in response to movement of said tool relative to said vehicle to thereby maintain said predetermined distance between said tool and said zone of said detector when said tool is moved relative to said vehicle;

electrical control circuitry energizable by the power supply and operatively connected to said first and second detecting arrays to receive said first and second control signals from said arrays, said control circuitry connected to said power device and responsive to said first and second control signals to actuate said power device to move said tool relative to said vehicle, causing said detector housing to be moved relative to said vehicle by said mounting so said detector in said detector housing closely follows the laser reference plane to retain the reference plane between said arrays, thus assuring said tool in said predetermined distance from the laser reference plane; and said detector support frame including means for controlling the coarseness of grading comprising a first carriage with one of said laser beam detecting arrays being mounted on said first carriage, said first carriage being wholly within said detector housing and movably mounted relative to said second array for movement toward and away from said second array to thereby vary the distance of separation between said arrays to permit said zone to be of a predetermined width suitable to the degree of coarseness permissible in working the given land surface.

2. The combination according to claim 1 wherein said means for controlling coarseness of grading further includes carriage drive means energizable from the power supply, carried by said detector housing and operatively, mechanically coupled to said first carriage to move said first carriage relative to said second array to thereby vary the distance of separation between said detecting arrays.

3. The combination according to claim 2 wherein said carriage drive means includes a reversible electric motor.

4. In combination with a vehicle having a power supply and movable over a given land surface and having a tool attached to the vehicle and movable toward and away from a laser reference plane generated by a swinging laser beam, and further including a power device carried by the vehicle, energizable by the power supply, and operatively connected with said tool to move said tool toward and away from the laser reference plane, an apparatus for maintaining a predetermined distance between said tool and the laser reference plane comprising:

a detector housing;

a detector support frame carried by said detector housing and having an outer periphery facing outwardly from said housing in a plurality of directions;

a laser reference plane detector carried by said detector support frame and energizable by the power supply, said detector including first and second laser beam detecting arrays, each said array including a plurality of light-sensitive devices attached to said outer periphery of said detector support frame and facing outwardly from said outer periphery in a plurality of directions, said light-sensitive devices of each array substantially centered on a common plane, with the common planes of said first and second arrays being generally parallel to and spaced from one another to define a zone therebetween, said first and second arrays producing first and second control signals, respectively, in response to detecting the laser reference plane;

a mounting carried by said vehicle and supporting said detector housing such that said zone is said predetermined distance from said tool, said mounting being movable relative to said vehicle to move said detector housing in response to movement of said tool relative to said vehicle to thereby maintain said predetermined distance between said tool and said zone of said detector when said tool is moved relative to said vehicle;

electrical control circuitry energizable by the power supply and operatively connected to said first and second detecting arrays to receive said first and second control signals from said arrays, said control circuitry connected to said power device and responsive to said first and second control signals to actuate said power device to move said tool relative to said vehicle, causing said detector housing to be moved relative to said vehicle by said mounting so said detector in said detector housing closely follows the laser reference plane to retain the reference plane between said arrays, thus assuring said tool is said predetermined distance from the laser reference plane; and said detector support frame including means for controlling the coarseness of grading comprising first and second carriages, said carriages being movably mounted relative to and wholly within said detector housing for converging and diverging simultaneous movement at the same rate of speed toward and away from one another, a said laser beam detecting array being carried on each of said carriages so that converging and diverging movement of said carriages decreases and increases, respectively, the distance separating said detecting arrays, said means for controlling the coarseness further including carriage drive means energizable from the power supply, carried by said detector housing and operatively, mechanically coupled to said first and second carriages to simultaneously move said carriages relative to said detector housing and toward and away from one another.

5. The combination according to claim 4 wherein said detector support frame includes guide means fixed relative to said detector housing, said guide means defining a path along which said first and second carriages move during said converging and diverging movement and further includes a shaft having a right-hand thread and a left-hand thread thereon, one said thread operatively coupled to said first carriage and the remaining said thread operatively coupled to said second carriage such that rotation of said shaft causes said first and second carriages to converge and diverge at the same rate of speed in response to forward and reverse rotation, respectively, of said shaft.

6. The combination according to claim 5 wherein said guide means comprises a pair of parallel, spaced apart rods fixed to said detector housing, each said carriage being mounted for sliding movement along said rods.

7. The combination of claim 5 and further including:

a rotation mounting connected between said detector housing and said mount to permit rotation of said housing relative to said mount; and an electric motor selectively energizable from the power source and operatively connected to rotate said detector housing relative to said mount to permit said detector carried by said detector housing to scan an arc to locate the laser beam.

8. The combination of claim 7 and further including:

measuring means electrically connectable to the power supply and carried by said vehicle, said measuring means determining the distance between said tool and said detector and generating an electrical grade signal containing information representative of the distance between said tool and said detector; and a display unit on said vehicle connectable to the power supply and electrically connected to said measuring means to receive said electrical grade signal from said measuring means and in response thereto to visibly display to an operator the numerical distance between said detector and said tool.

* * * * *